US008788157B2

(12) United States Patent
Shintani et al.

(10) Patent No.: US 8,788,157 B2
(45) Date of Patent: Jul. 22, 2014

(54) CONTROL METHOD FOR DRIVING A RIPPER

(71) Applicant: Komatsu Ltd., Tokyo (JP)

(72) Inventors: Satoru Shintani, Takatsuki (JP); Tomohiro Nakagawa, Hirakata (JP); Ryouichi Nagasaka, Fujisawa (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 14/063,082

(22) Filed: Oct. 25, 2013

(65) Prior Publication Data

US 2014/0048294 A1 Feb. 20, 2014

Related U.S. Application Data

(62) Division of application No. 13/392,845, filed as application No. PCT/JP2011/070386 on Sep. 7, 2011, now Pat. No. 8,616,297.

(30) Foreign Application Priority Data

Sep. 14, 2010 (JP) ..... 2010-205149

(51) Int. Cl.

| | |
|---|---|
| ***G06F 7/70*** | (2006.01) |
| ***G06F 19/00*** | (2011.01) |
| ***G06G 7/00*** | (2006.01) |
| ***G06G 7/76*** | (2006.01) |
| ***E02F 9/20*** | (2006.01) |
| ***E02F 9/26*** | (2006.01) |
| ***E02F 5/32*** | (2006.01) |
| ***E02F 3/76*** | (2006.01) |
| ***E02F 9/22*** | (2006.01) |
| ***E02F 3/96*** | (2006.01) |

(52) U.S. Cl.

CPC ... *E02F 9/20* (2013.01); *E02F 9/26* (2013.01); *E02F 5/32* (2013.01); *E02F 9/2004* (2013.01); *E02F 3/7609* (2013.01); *E02F 9/22* (2013.01); *E02F 3/961* (2013.01)

USPC ..... 701/50; 172/2; 180/333

(58) Field of Classification Search

USPC ..... 701/50, 84; 172/1, 2, 3, 4, 464, 9; 180/197

See application file for complete search history.

(56) References Cited

U.S. PATENT DOCUMENTS

| | | | |
|---|---|---|---|
| 3,973,632 | A | 8/1976 | Torazzi |
| 4,159,474 | A | 6/1979 | Wooldridge |

(Continued)

FOREIGN PATENT DOCUMENTS

| | | | |
|---|---|---|---|
| CN | 2346659 | Y | 11/1999 |
| CN | 1727584 | A | 2/2006 |

(Continued)

OTHER PUBLICATIONS

The Chinese Office Action for the corresponding Chinese application No. 201180003481.6, issued on Jan. 22, 2014.

*Primary Examiner* — Árpád Fábián-Kovács
(74) *Attorney, Agent, or Firm* — Global IP Counselors, LLP

(57) ABSTRACT

A method for driving a ripper is provided in which the movement of a ripper attached to the rear of the body of a bulldozer is controlled. The method includes a first step in which the ripper is operated while the bulldozer is moving forward or is stopped, a second step in which the bulldozer is reversed and the ripper is raised, and a third step in which the ripper is automatically raised.

9 Claims, 9 Drawing Sheets

(56) References Cited

U.S. PATENT DOCUMENTS

| | | | | |
|---|---|---|---|---|
| 5,287,280 | A * | 2/1994 | Yamamoto et al. | 701/84 |
| 5,293,944 | A | 3/1994 | Matsumoto | |
| 5,297,649 | A * | 3/1994 | Yamamoto et al. | 180/197 |
| 5,685,377 | A | 11/1997 | Arstein et al. | |
| 5,999,872 | A * | 12/1999 | Kinugawa et al. | 701/50 |
| 7,658,234 | B2 * | 2/2010 | Brandt et al. | 172/7 |
| 7,793,740 | B2 | 9/2010 | Thomson et al. | |
| 8,146,704 | B2 | 4/2012 | Ruhter et al. | |
| 8,437,926 | B2 * | 5/2013 | Shintani et al. | 701/50 |
| 2006/0021819 | A1 | 2/2006 | Shearer et al. | |
| 2009/0223734 | A1 | 9/2009 | Frett et al. | |
| 2009/0223735 | A1 | 9/2009 | Ruhter et al. | |
| 2009/0223736 | A1 | 9/2009 | Ruhter et al. | |
| 2010/0108336 | A1 | 5/2010 | Thomson et al. | |
| 2010/0212450 | A1 | 8/2010 | Miyasaka et al. | |
| 2011/0036603 | A1 | 2/2011 | Ruhter et al. | |
| 2012/0073843 | A1 | 3/2012 | Kure et al. | |
| 2012/0103717 | A1 | 5/2012 | Ruhter et al. | |
| 2012/0267128 | A1 * | 10/2012 | Shintani et al. | 172/1 |

FOREIGN PATENT DOCUMENTS

| | | | |
|---|---|---|---|
| DE | 19738975 | A1 | 3/1998 |
| JP | 7-197486 | A | 8/1995 |
| JP | 10-88614 | A | 4/1998 |
| WO | 2009/075210 | A1 | 6/2009 |

* cited by examiner

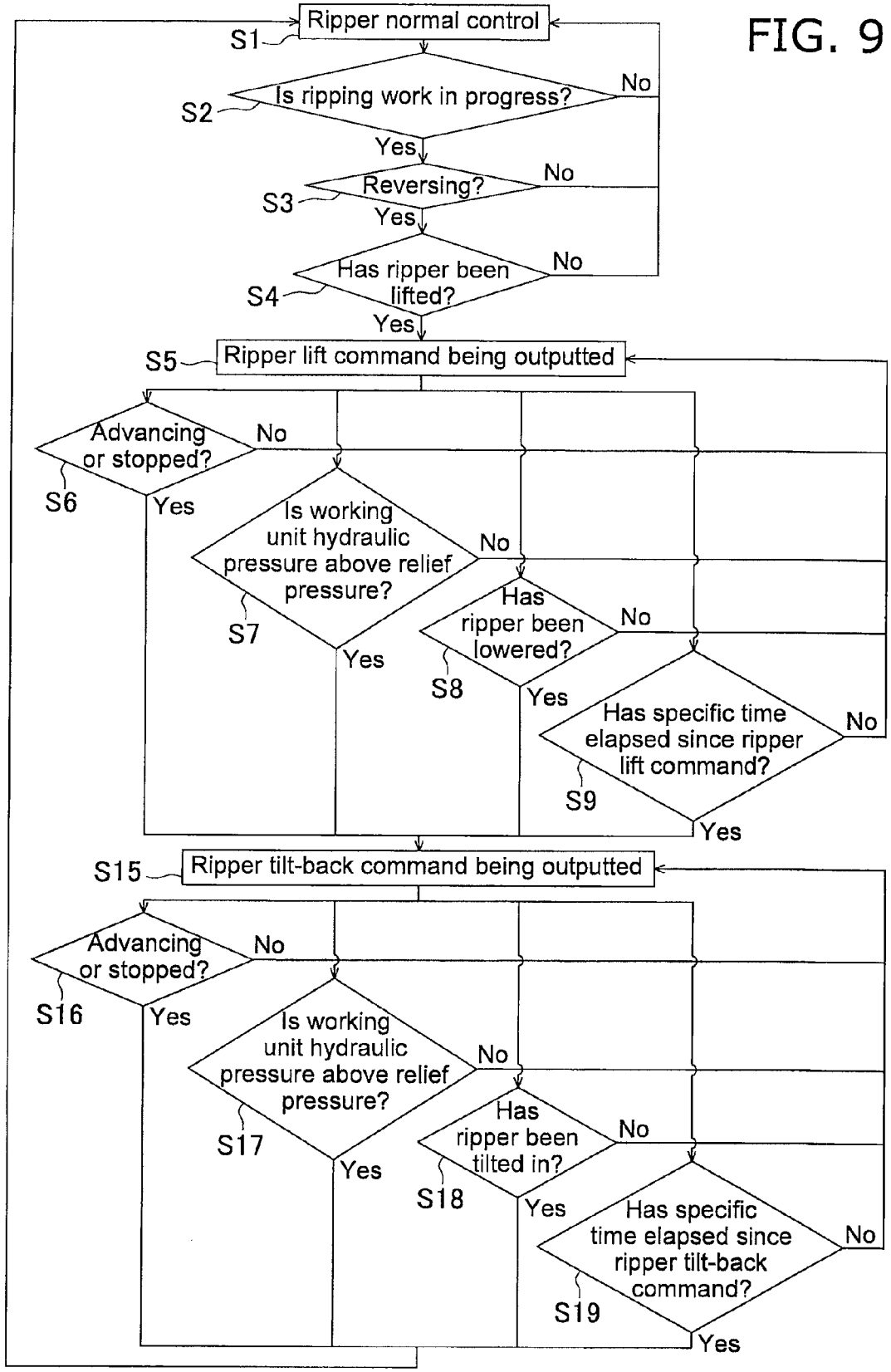
FIG. 9
Ripper normal control
S1
Is ripping work in progress?
S2
No
Yes
Reversing?
S3
No
Yes
Has ripper been lifted?
S4
No
Yes
Ripper lift command being outputted
S5
Advancing or stopped?
S6
No
Yes
Is working unit hydraulic pressure above relief pressure?
S7
No
Yes
Has ripper been lowered?
S8
No
Yes
Has specific time elapsed since ripper lift command?
S9
No
Yes
Ripper tilt-back command being outputted
S15
Advancing or stopped?
S16
No
Yes
Is working unit hydraulic pressure above relief pressure?
S17
No
Yes
Has ripper been tilted in?
S18
No
Yes
Has specific time elapsed since ripper tilt-back command?
S19
No
Yes

CONTROL METHOD FOR DRIVING A RIPPER

BACKGROUND OF THE INVENTION

1. Field of the Invention

The present invention relates to a control method for driving a ripper in order to perform digging and other such work.

2. Description of the Related Art

In the past, a ripper mounted to the rear of the body of a bulldozer has been used to perform digging work in rock or hard soil.

For example, as an apparatus for automatically controlling the ripping work of such a ripper, Patent Literature 1 discloses an apparatus in which an auto return button is provided for automatically lifting a ripper to a certain position when the button is pressed by the operator.

CITATION LIST

Patent Literature

Patent Literature 1: Japanese Laid-Open Patent Application H10-88614 (laid open on Apr. 7, 1998)

SUMMARY OF THE INVENTION

However, the following problems were encountered with this conventional ripper drive control device.

Specifically, with the ripper drive control device disclosed in the above-mentioned publication, the operator has to depress the auto return button in order to execute automatic control, so this entails operation other than the usual operation in ripping work. Accordingly, the operator has to add a new operation to the operation performed in ordinary ripping work, which is a problem in that the ripping work cannot be performed as same as in the past.

Problem to be Solved by the Invention

It is an object of the present invention to provide a bulldozer with which less burden is imposed on the operator during ripping work, while allowing operation as same as in the past.

Means for Solving Problem

The control method for driving a ripper pertaining to the present invention is a method for driving a ripper in which the movement of a ripper attached to the rear of the body of a bulldozer is controlled, said method comprising a first step in which it is detected that ripping work by the ripper has ended, and a second step in which a first control of pulling the ripper out of a ground and a second control of tilting back the ripper are selectively executed when it is detected that the ripping work has ended.

BRIEF DESCRIPTION OF DRAWINGS

FIG. 9 is a flowchart showing the flow of automatic ripper return control (linked lifting and tilting) performed by the control device in FIG. 4.

DETAILED DESCRIPTION OF THE INVENTION

The bulldozer 1 pertaining to an embodiment of the present invention will be described below through reference to FIGS. 1 to 9.

Overall Configuration of Bulldozer 1

Figure 1:
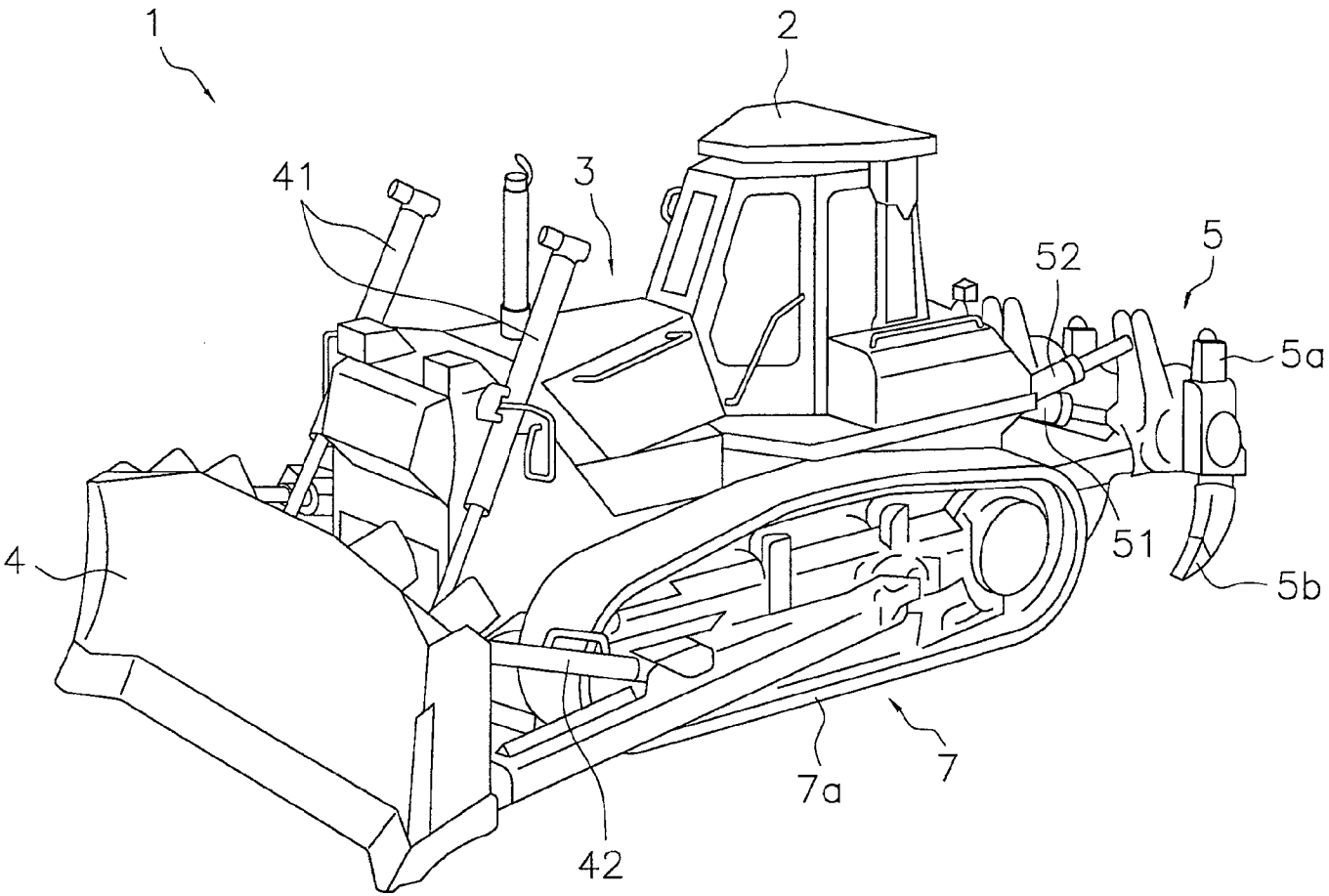
FIG. 1 is an overall oblique view of the configuration of the bulldozer pertaining to an embodiment of the present invention.

The bulldozer 1 pertaining to this embodiment is a construction machine that performs leveling on uneven ground. As shown in FIG. 1, the bulldozer 1 mainly comprises a cab 2, a vehicle body frame 3, a blade 4, a ripper 5, and a drive unit 7.

Figure 2:
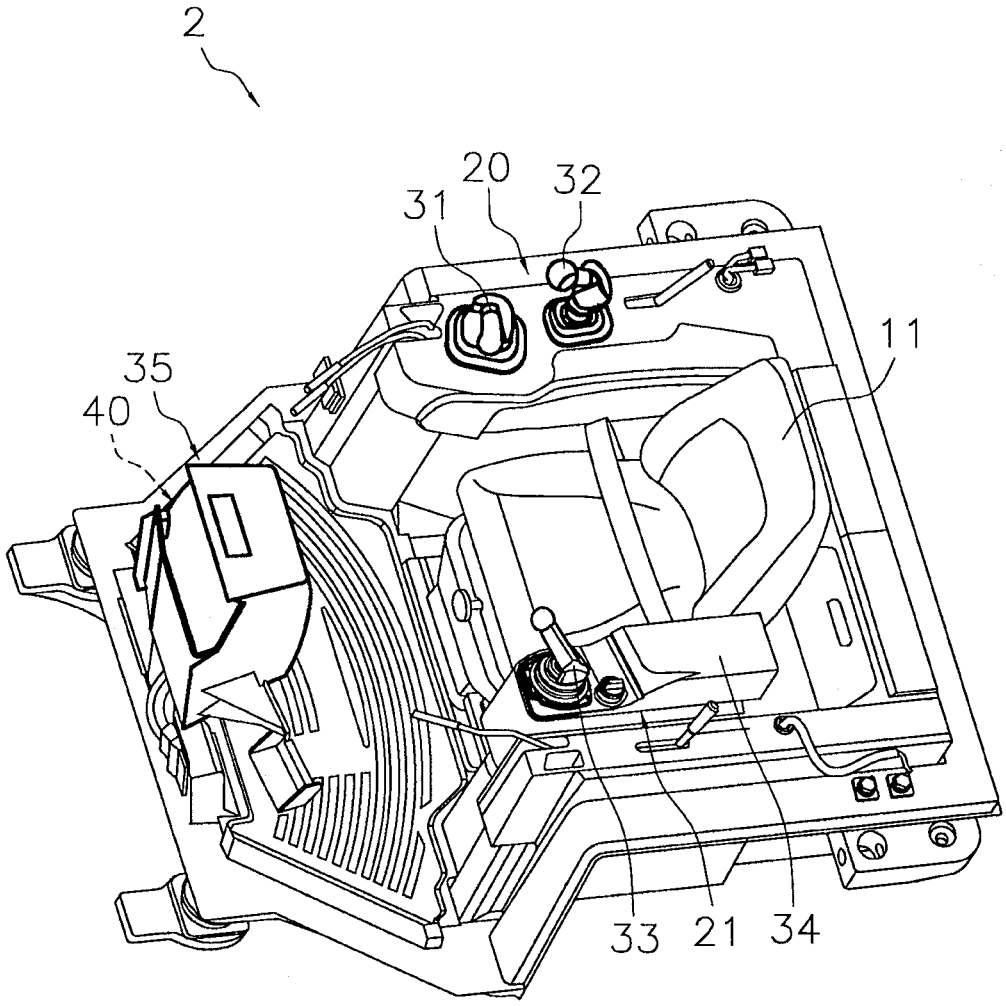
FIG. 2 is an oblique view of the configuration of the inside of a cab mounted on the bulldozer in FIG. 1.

The cab 2 is equipped with an operator's seat (driver's seat) 11 for the operator to sit on, and levers, pedals, gauges, and so forth for performing various operations (see FIG. 2). The interior configuration of the cab 2 will be discussed in detail later.

The drive unit 7 and the blade 4, ripper 5, and other such working mechanisms are attached to the vehicle body frame 3, and the cab 2 is installed on top of it. The blade 4 is provided in front of the vehicle body frame 3, is a work implement for scraping off the ground surface and pushing around earth, and is driven by hydraulic cylinders (a blade lift cylinder 41 and a blade tilt cylinder 42) according to the operation of a blade operating lever 31 (discussed below).

The ripper 5 is provided to the rear of the vehicle body frame (body) 3. The ripper 5 thrusts a ripping tip 5*b* into rock or the like. The ripping tip 5*b* is attached to the distal end of a shank 5*a* protruding substantially vertically downward. The ripper 5 cuts or breaks the ground by traction force provided by the drive unit 7. The ripper 5 is similar to the blade 4 in that it is driven by hydraulic cylinders (a ripper lift cylinder 51 and a ripper tilt cylinder 52) according to the operation of a ripper operating lever 32 (discussed below). The method for controlling the ripping work performed using this ripper 5 will be discussed in detail below.

The drive unit 7 allows the bulldozer to travel over uneven ground by rotating a pair of endless crawler belts 7*a* provided to the left and right lower parts of the vehicle body frame 3.

Configuration of Cab 2 Interior

As shown in FIG. 2, the interior of the cab 2 in this embodiment is equipped with the operator's seat 11, right-hand controls 20, left-hand controls 21, a monitor 35, a control device (detector, controller) 40, and so forth.

The operator's seat 11 is the seat in which the operator sits after climbing into the cab 2, and performs driving operations, and this seat is installed so that it can slide forward and backward. The operator's seat 11 is also installed so as to be rotatable, so that the operator can more easily work the controls when operating the ripper 5, etc., while looking backward. Various operating levers and other such operational machinery that are operated by the operator are installed on the left and right sides of the operator's seat 11.

As shown in FIG. 2, the right-hand controls 20 are disposed on the right side of the operator's seat 11 as viewed by the operator when seated in the operator's seat 11. The blade operating lever 31, the ripper operating lever 32, and so forth are provided on the upper surface of the right-hand controls 20.

Figure 3:
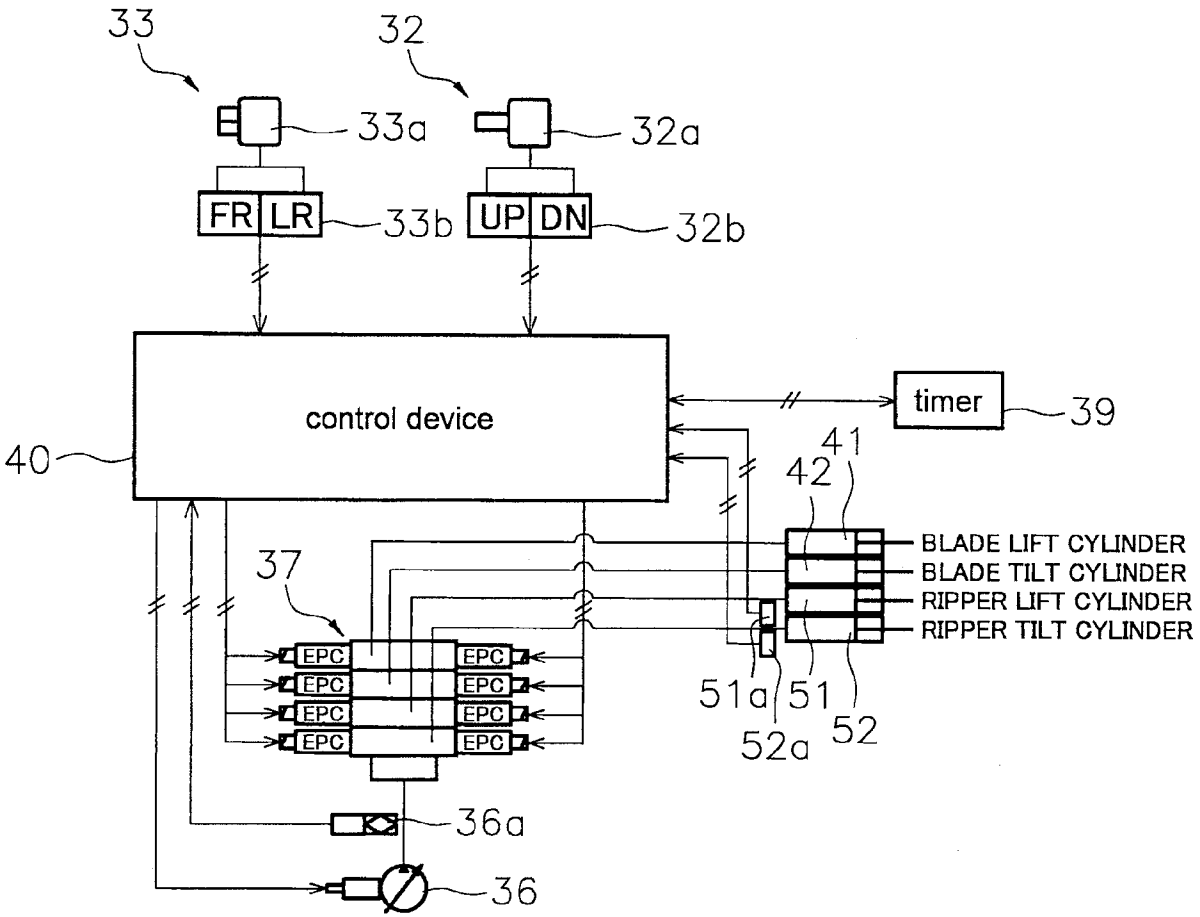
FIG. 3 is a block diagram of the configuration of a control device installed in the bulldozer in FIG. 1, and of the surrounding area.

The blade operating lever 31 is provided at the very front part of the upper surface of the right-hand controls 20, and actuates the blade lift cylinder 41 and blade tilt cylinder 42 that drive the blade 4 (see FIGS. 1 and 3).

The ripper operating lever 32 is provided adjacent to and to the rear of the blade operating lever 31 on the upper face of the right-hand controls 20, and actuates the ripper lift cylinder 51 and ripper tilt cylinder 52 that drive the ripper 5 (see FIGS. 1 and 3). The ripper operating lever 32 also has a ripper tilting lever 32*a* and a ripper lifting lever 32*b* (see FIG. 3). The ripper tilting lever 32*a* is used to tilt the ripper 5 in and out, and actuates the ripper tilt cylinder 52. The ripper lifting lever 32*b* is used to lift and lower the ripper 5, and actuates the ripper lift cylinder 51.

As shown in FIG. cab 2, the left-hand controls 21 are disposed on the left side of the operator's seat 11 as viewed by the operator when seated in the operator's seat 11. A steering lever 33, an armrest 34, and so forth are provided on the upper surface of the left-hand controls 21.

The steering lever 33 is swiveled backward and forward and to the left and right when the forward direction of the vehicle is in front, thereby providing steering. The steering lever 33 also has a shift switch 33*a* and a steering lever 33*b* (see FIG. 3). The shift switch 33*a* is used to change the transmission gears, and changes the gear according to the travel speed when the vehicle is moving forward and backward. The steering lever 33*b* can be swiveled in four directions (forward, backward, left, and right) and can control the traveling direction of the bulldozer 1. When swiveled forward, the bulldozer 1 advances, when swiveled backward, the bulldozer 1 reverses, when swiveled to the left, the bulldozer 1 turns left, and when swiveled to the right, the bulldozer 1 turns right.

The armrest 34 has a raised portion along its left edge, and this raised portion supports the operator's weight when the center of gravity shifts to the left side.

The monitor 35 is a touch-sensitive panel type of display device disposed in front of the operator's seat 11. As shown in FIG. 2, this monitor 35 has a control panel 35*a* and touch keys 35*b* (see FIG. 5*a*). The monitor 35 is also used by the operator to input various settings related to the operation of the bulldozer 1, and to input settings related to controlling the ripping work with the ripper 5 (discussed below).

As shown in FIG. 2, the control device 40 is installed in the interior of the monitor 35, and controls the travel of the bulldozer 1 and the operation in performing various kinds of work. Also, as shown in FIG. 3, the control device 40 is connected with the ripper operating lever 32, the steering lever 33, a hydraulic pump 36, a hydraulic sensor 36*a*, a main valve 37, a timer 39, the blade lift cylinder 41, the blade tilt cylinder 42, the ripper lift cylinder 51, a hydraulic sensor 51*a*, the ripper tilt cylinder 52, and a hydraulic sensor 52*a*, and sends and receives various kinds of signal between these components. More specifically, the control device 40 controls the main valve 37, which decides where to send the hydraulic fluid supplied from the hydraulic pump 36, and the discharge amount of the hydraulic pump 36, in the hydraulic circuit of the bulldozer 1 according to the operation of the ripper operating lever 32 and the steering lever 33, and thereby actuates the hydraulic cylinders 41, 42, 51, and 52 that drive the work implements, including the blade 4 and the ripper 5. The automatic ripper return control during ripping work by the control device 40 will be discussed in detail below.

Flow of Ripping Work

The flow of ripping work using the ripper 5 of the bulldozer 1 will now be described through reference to FIG. 4.

Figure 4:
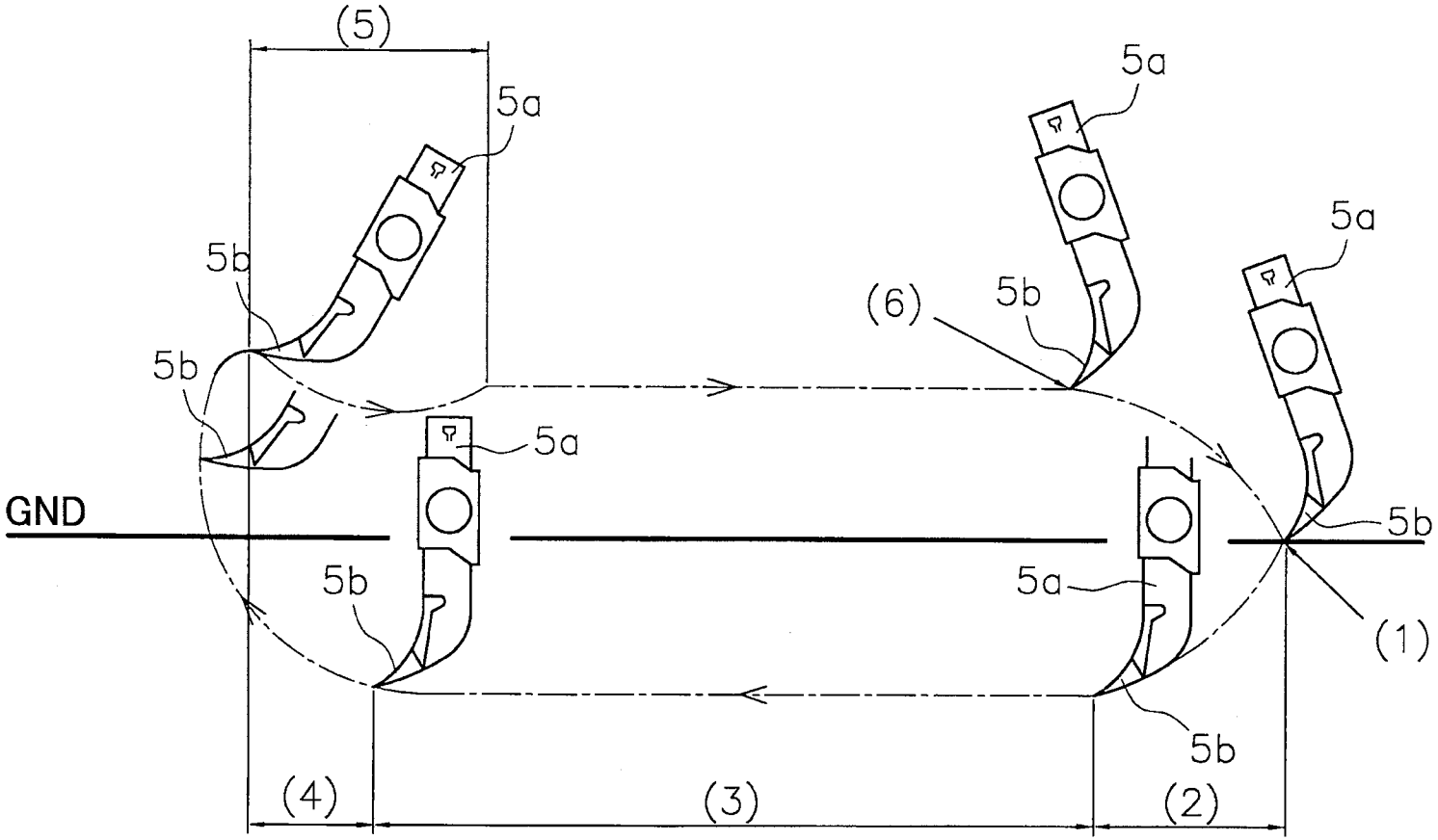
FIG. 4 is a diagram illustrating the flow of ripping work performed by a ripper provided to the rear part of the body of the bulldozer in FIG. 1.
Figure 5:
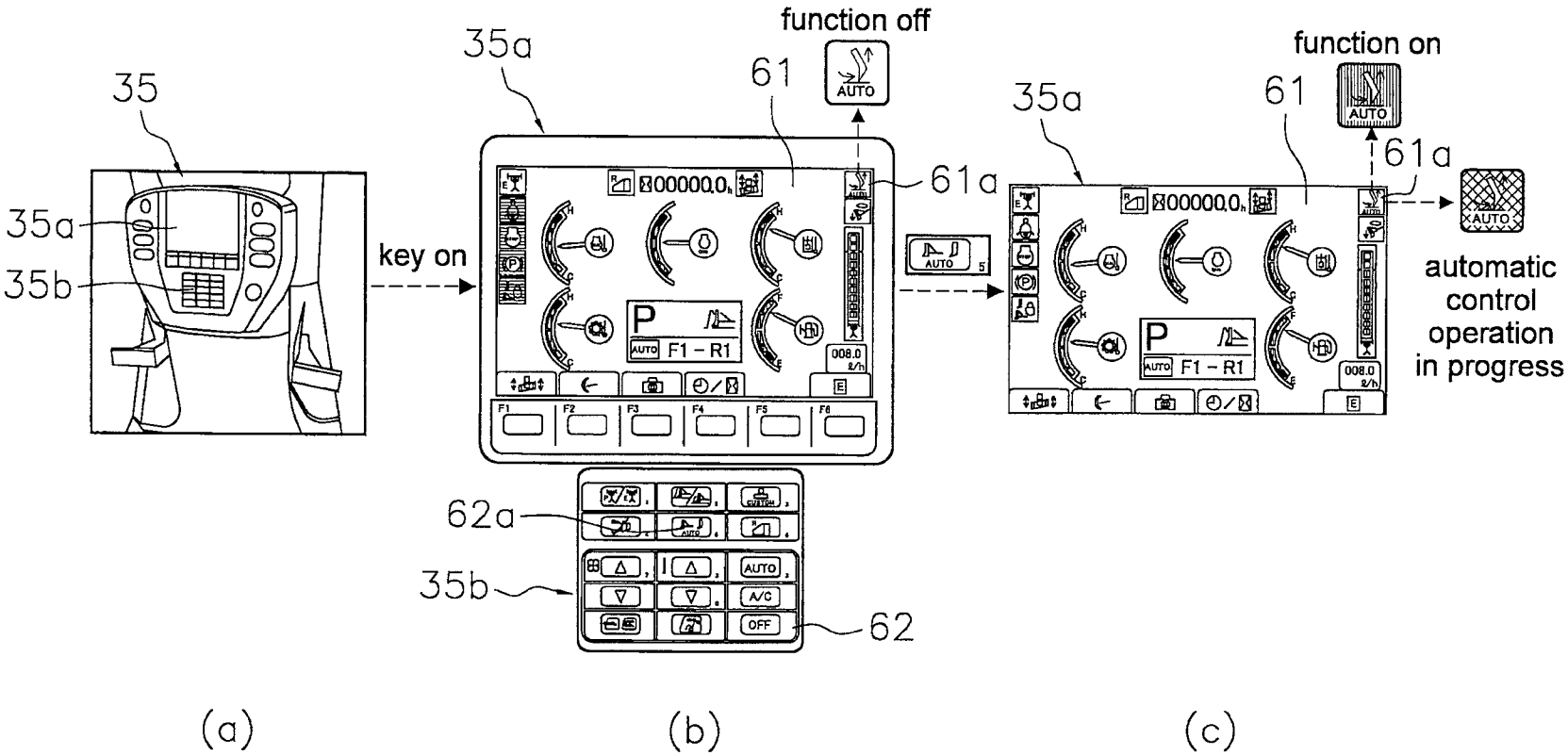
FIGS. 5*a* to 5*c* are diagrams of a monitor installed in the cab in FIG. 2, and a display screen used in setting automatic ripper return control.
Figure 6:
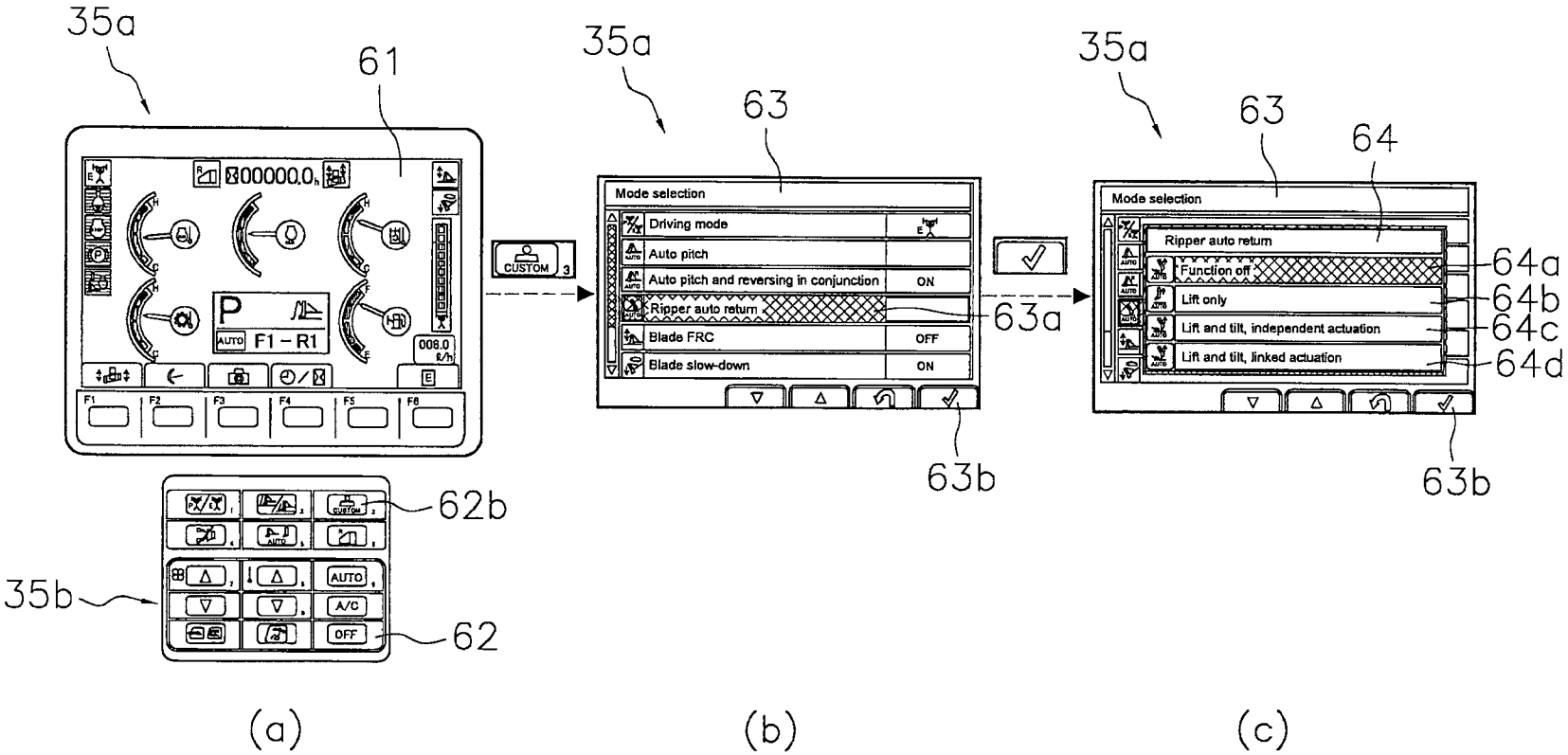
FIGS. 6*a* to 6*c* are diagrams of mode selection screens for the automatic ripper return control.

In ordinary ripping work using the ripper 5, the operator performs the work while performing various operations by the procedure shown in FIG. 4. (1) to (6) below correspond to the operations in (1) to (6) shown in FIG. 4. In the following description, "tilt-in" means that the shank 5*a* is rotated clockwise in FIG. 4 (the direction indicated by the ripping tip 5*b*), and "tilt-out" means that the shank is rotated in the opposite direction.

(1) The operator operates the ripper tilting lever 32*a* to tilt back the shank 5*a*, and the ripping tip 5*b* is placed on the ground at the ripping start point in this state. The operator then operates the ripper lifting lever 32*b* to raise the rear part of the body of the bulldozer 1 with the ripper lift cylinder 51.

(2) The operator steps on the decelerator pedal in the cab 2 to lower the engine speed, and operates the shift switch 33*a* to put the bulldozer in gear F1. The operator then operates the ripper tilting lever 32*a* to plunge the ripping tip 5*b* down to the desired depth in the ground.

(3) When the ripping tip 5*b* has plunged to the desired depth, the operator sets the engine speed to "max," and operates the steering lever 33*b* to move the bulldozer 1 forward and perform digging work. At this point the operator operates the ripper tilting lever 32*a* to perform ripping work while tilting the shank 5*a*.

(4) When the bulldozer 1 has advanced to the desired position and the ripping work ends, the operator operates the ripper lifting lever 32*b* to remove the shank 5*a* from the rock while the bulldozer 1 is advancing. After this, the operator operates the steering lever 33*b* to reverse the bulldozer 1.

(5) While reversing the bulldozer 1, the operator operates the ripper tilting lever 32*a* to tilt back the shank 5*a*.

(6) When the bulldozer 1 has reversed to a position close to the next ripping start point, the operator operates the ripper lifting lever 32*b* to lower the shank 5*a* until the ripping tip 5*b* hits the ground at the ripping start point. The operations of (1) to (6) are then repeated.

Usually, in performing this ripping work, in the cab 2 shown in FIG. 2, the operator holds the ripper operating lever 32 with his right hand to operate the ripper 5, while holding the steering lever 33 in his left hand to switch between advancing and reversing, while checking in front and back of the bulldozer 1.

The operations in (4) and (5) here must be performed each time as preparatory work after performing one row of ripping work and until the next ripping work is to be performed. These operations must be carried out simultaneously, while checking ahead and behind, so this imposes a considerable burden on the operator.

In particular, since the ripper operating lever 32 is provided on the right side of the operator's seat 11, and the steering lever 33 on the left side, in the cab 2 of the bulldozer 1 shown in FIG. 2, the operator must do different operations with his left and right hands while checking ahead and behind, and perform preparatory work until the next ripping work is performed, which means that the operability is extremely inferior.

Setting of Automatic Ripper Return Control

In this embodiment, ripper automatic return control setting is performed by the following procedure in order to reduce the operational burden on the operator during the above-mentioned ripping work. Specifically, in performing automatic ripper return control (ripper auto return), as shown in FIG. 5*a*, first settings are made using the control panel 35*a* and touch keys 35*b* on the monitor 35 provided in the cab 2.

More specifically, when the operator turns a key in the cab 2 to switch on the system, as shown in FIG. 5*b*, a normal screen 61 is displayed on the control panel 35*a*, and a touch key screen 62 is on the touch keys 35*b*. On the normal screen 61 immediately after this key start, the automatic return control starts up in a function-off state, and an automatic control function display component 61*a* in the upper-right of the screen is displayed in a color indicating a function-off state (such as blue, which is the same as the background color of the normal screen 61).

Next, when the operator presses an automatic control function on/off button 62*a* disposed in the center of the upper part of the touch key screen 62, as shown in FIG. 5*c*, the automatic control function display component 61*a* at the upper-right of the normal screen 61 changes to a color (such as green) that indicates the function is on. This automatic control function display component 61*a* changes to a color (such as yellow) indicating that automatic control is in progress, when a specific condition (discussed below) is met and automatic ripper return control is commenced. This tells the operator that automatic return control is operating.

Mode Setting of Automatic Ripper Return Control

In this embodiment, this automatic ripper return control can be set to three different modes: control in which the operation of just (4) above (lift operation) is automated (first mode), control in which the operations of (4) and (5) above are automated so as to work independently (lift/tilt independent actuation) (second mode), and control in which the operations of (4) and (5) above are automated so as work in conjunction (linked lift/tilt operation).

Thus, the operator selects among these three modes by performing the following procedure.

Specifically, as shown in FIG. 6*a*, in a state in which the normal screen 61 is displayed on the monitor 35, when the operator depresses a mode select button 62*b* on the touch key screen 62, a mode select screen 63 is displayed on the monitor 35 as shown in FIG. 6*b*.

Then, as shown in FIG. 6*b*, the operator selects a ripper auto return button 63*a* from the mode select screen 63, and when a select button 63*b* is depressed, an automatic control mode selection screen 64 is displayed on the mode select screen 63 as shown in FIG. 6*c*.

As shown in FIG. 6*c*, four selection options are displayed on the automatic control mode selection screen 64: a function-off button 64*a*, a lift-only selection button 64*b*, a lift/tilt independent actuation selection button 64*c*, and a lift/tilt linked actuation selection button 64*d*.

Thus, the operator can have the control device 40 execute automatic ripper return control by selecting the work to be automated and depressing the select button 63*b* to select the desired mode.

Flow of Automatic Ripper Return Control

With the control device 40 installed in the bulldozer 1 of this embodiment, when the above-mentioned setting of automatic return control is complete, if all of the following specific conditions (steps S2 to S4) have been satisfied, the system switches from normal control to automatic ripper return control. On the other hand, after automatic ripper return control has started, if any of the following specific conditions (steps S6 to S9) have been satisfied, the system switches from automatic ripper return control to normal control.

Automatic Lift Control

First, of the operations performed after completion of ripping work discussed above, we will describe control in which the lifting of the ripper 5 is automated as in (4) shown in FIG. 4.

Figure 7:
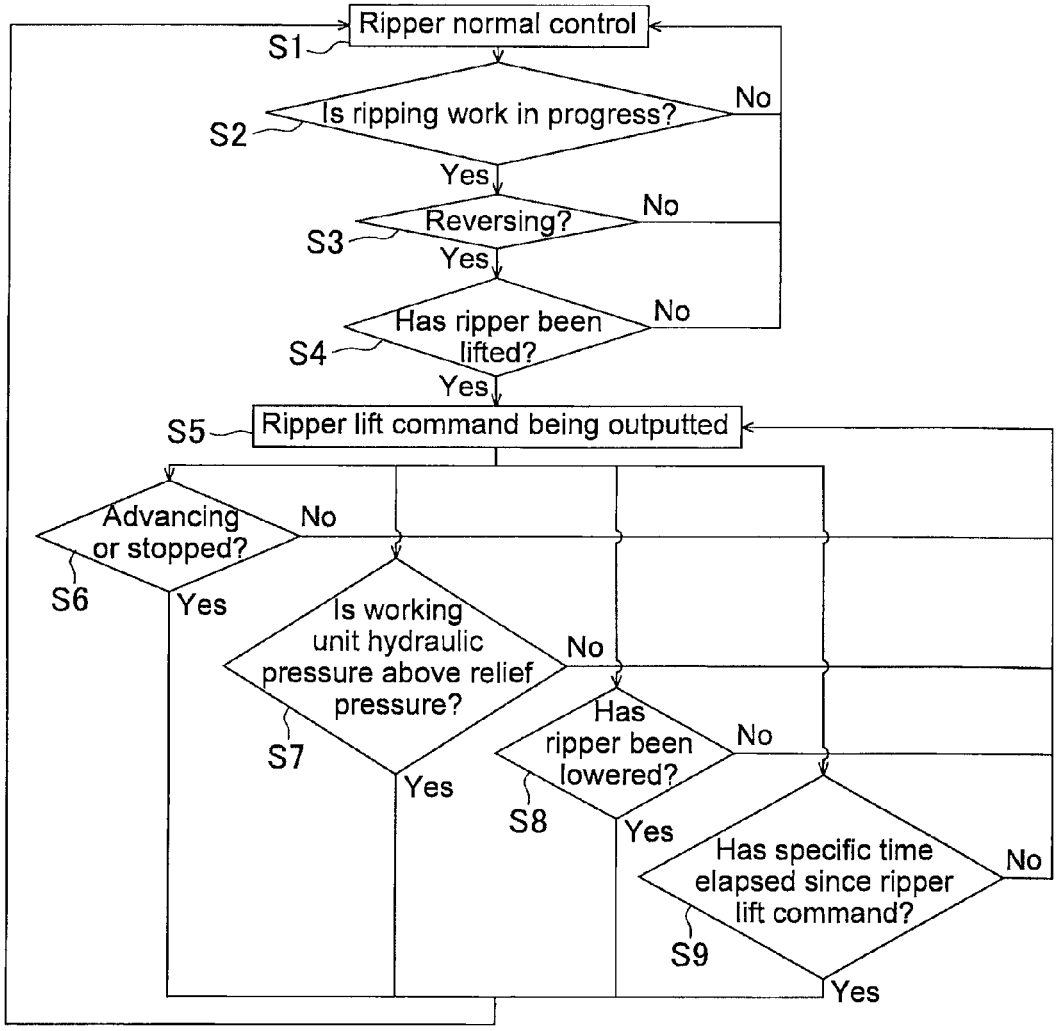
FIG. 7 is a flowchart showing the flow of automatic ripper return control (lifting) performed by the control device in FIG. 4.

Specifically, as a result of the above-mentioned mode setting, when the lift-only selection button 64*b* is selected on the automatic control mode selection screen 64, as shown in FIG. 7, the flow goes from a state of normal ripper control in step S1 to step S2.

In step S2, it is determined whether or not ripping work is in progress, and if it is, the flow proceeds to step S3, and otherwise returns to step S1. More specifically, the determination of whether or not ripping work is in progress is made by whether the ripper 5 has been lowered or tilted in while the bulldozer 1 is advancing, or whether the ripper 5 has been lowered while the bulldozer 1 is stopped. This avoids, for example, a situation in which the automatic ripper return control is accidentally performed during dozing work with the blade 4.

In step S3, it is determined whether or not the bulldozer 1 is reversing, and if it is, the flow proceeds to step S4. Here, it is confirmed that the ripping work has ended and the bulldozer 1 is still reversing.

In step S4, it is determined whether or not the operator has moved the ripper operating lever 32 to the lift position, and if so, the flow proceeds to step S5. Here, whether or not the ripper has been lifted can be detected from the position of the ripper operating lever 32.

In step S5, since the condition that the ripping work has ended and automatic return control has started has been satisfied in steps S2 to S4, the control device 40 automatically lifts the ripper 5 by outputting a command to lift the ripper 5.

Specifically, in this embodiment, if the operator even momentarily puts the ripper operating lever 32 in the lift position in a state in which ripping work is ended and the bulldozer is reversing in steps S2 and S3, after that the lift operation of the ripper 5 will be automatically continued even if the operator removes his hand from the ripper operating lever 32.

Consequently, the operator can have the rest of the lift operation carried out automatically just by putting the ripper operating lever 32 in the lift position, just as with normal control, as a cue to start automatic ripper return control. Thus, the operator can concentrate on operating the steering lever 33 while reversing, and thereby move the bulldozer 1 to the next point where ripping work is to be started. As a result, part of the operation after the completion of ripping work can be automated while the operator performs the same operations as in ordinary ripping work, without having to depress any particular buttons or the like, and this reduces the operational burden on the operator.

Next, in the following steps S6 to S9, we will describe the conditions for releasing this automatic ripper return control and switching to normal control. In this embodiment, as shown in FIG. 7, automatic ripper return control is released when any of the conditions in steps S6 to S9 is satisfied.

In step S6, it is determined whether or not the bulldozer 1 is advancing or stopped. This is because if it is detected that the operator has operated the steering lever 33 in an effort to move forward from a state in which the bulldozer 1 is reversing, this recognizes a situation in which the operator is trying to go to the next ripping work, and releases the automatic ripper return control.

In step S7, it is determined whether or not the work implement hydraulic pressure has been relieved in the hydraulic circuit. This is because the automatic ripper return control is stopped or cancelled if the system detects that the ripper 5 has been lifted or rotated, or that the blade 4 has been operated. The determination in step S7 is made on the basis of the detection result of the hydraulic sensor 36*a*, which detects the discharge pressure of the hydraulic pump 36, the hydraulic sensor 51*a*, which detects the discharge pressure to the ripper lift cylinder 51, or the hydraulic sensor 52*a*, which detects the discharge pressure to the ripper tilt cylinder 52.

In step S8, it is determined whether or not the ripper 5 has been lowered. That is, if the ripper operating lever 32 is in its lowering position, it is assumed that the operator is attempting to start the next ripping work, so the automatic ripper return control is released. This may be determined by detection of the position of the ripper operating lever 32. The automatic control can be effectively released by detecting operation in the opposite direction from that of the movement of the ripper 5 under the automatic control, and giving manual operation by the operator priority over automatic control.

In step S9, it is determined from the output of the timer 39 whether or not a specific length of time has elapsed since the output of a ripper lift command from the control device 40. This assumes a case in which the automatic ripper return control is not properly released after its start based on the release conditions of steps S6 to S8, and is a release condition set for the purpose of safety.

In this embodiment, as discussed above, when the automatic ripper return control is started, if any of the release conditions of steps S6 to S9 has been met, the automatic ripper return control is released and the system switches to normal control.

If manual operation is then detected in which the operator has switched operation of the ripper operating lever 32 (from lifting to lowering) or operation of the steering lever 33 (from reversing to advancing), priority is given to manual operation over automatic control and the ripper 5 is stopped, which provides greater safety in automatic control.

Automatic Tilt Control

Next, of the operations after completion of the above-mentioned ripping work, we will describe control in which the tilting of the ripper 5 in (5) shown in FIG. 4 is automated.

Figure 8:
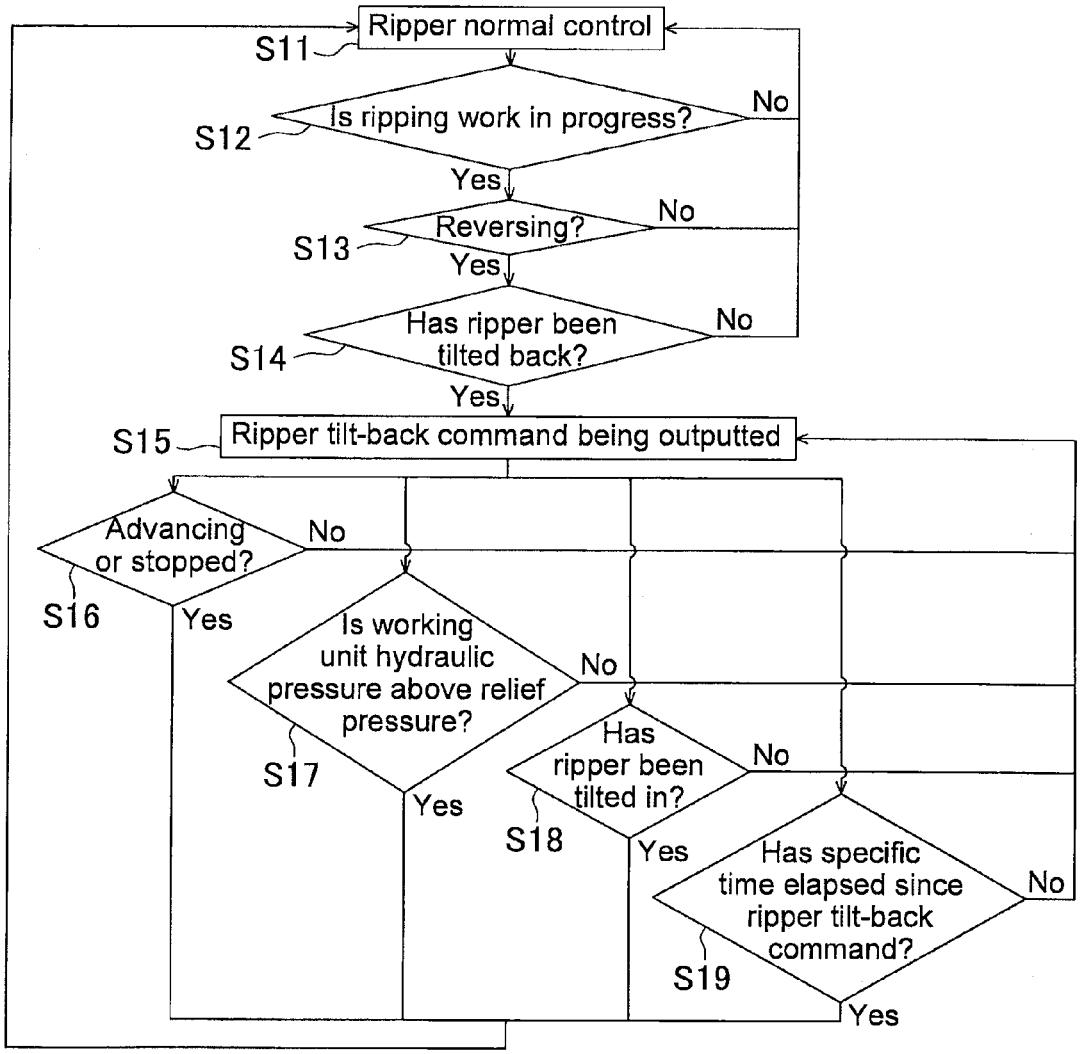
FIG. 8 is a flowchart showing the flow of automatic ripper return control (tilting) performed by the control device in FIG. 4.

Specifically, when the lift/tilt independent actuation selection button 64*c* is selected on the automatic control mode selection screen 64, the automatic tilt control shown in FIG. 8 is executed independently from the automatic lift control shown in FIG. 7.

More specifically, as shown in FIG. 8, the flow goes from a state of normal ripper control in step S11 to step S12.

In step S2, it is determined whether or not ripping work is in progress, and if it is, the flow proceeds to step S13, and otherwise returns to step S11. More specifically, the determination of whether or not ripping work is in progress is made by whether the ripper 5 has been lowered or tilted in while the bulldozer 1 is advancing, or whether the ripper 5 has been lowered while the bulldozer 1 is stopped. This avoids, for example, a situation in which the automatic ripper return control is accidentally performed during dozing work with the blade 4.

In step S13, it is determined whether or not the bulldozer 1 is reversing, and if it is, the flow proceeds to step S14. Here, it is confirmed that the ripping work has ended and the bulldozer 1 is still reversing.

In step S14, it is determined whether or not the operator has moved the ripper operating lever 32 to the tilt-back position, and if so, the flow proceeds to step S15. Here, whether or not the ripper has been tilted back can be detected from the position of the ripper operating lever 32 (the ripper tilting lever 32*a*).

In step S15, since the condition that the ripping work has ended and automatic return control has started has been satisfied in steps S12 to S14, the control device 40 automatically tilts the ripper 5 back by outputting a command to tilt back the ripper 5.

Specifically, in this embodiment, if the operator even momentarily puts the ripper operating lever 32 in the tilt-back position in a state in which ripping work is ended and the bulldozer is reversing in steps S12 and S13, after that the tilt-back operation of the ripper 5 will be automatically continued even if the operator removes his hand from the ripper operating lever 32.

Consequently, the operator can have the rest of the tilt-back operation carried out automatically just by putting the ripper operating lever 32 in the tilt-back position, just as with normal control, as a cue to start automatic ripper return control. Thus, the operator can concentrate on operating the steering lever 33 while reversing, and thereby move the bulldozer 1 to the next point where ripping work is to be started. As a result, part of the operation after the completion of ripping work can be automated while the operator performs the same operations as in ordinary ripping work, without having to depress any particular buttons or the like, and this reduces the operational burden on the operator.

Next, in the following steps S16 to S19, we will describe the conditions for releasing this automatic ripper return control and switching to normal control. In this embodiment, as shown in FIG. 8, automatic ripper return control is released when any of the conditions in steps S16 to S19 is satisfied.

In step S16, it is determined whether or not the bulldozer 1 is advancing or stopped. This is because if it is detected that the operator has operated the steering lever 33 in an effort to move forward from a state in which the bulldozer 1 is reversing, this recognizes a situation in which the operator is trying to go to the next ripping work, and releases the automatic ripper return control.

In step S17, it is determined whether or not the work implement hydraulic pressure has been relieved in the hydraulic circuit. This is because the automatic ripper return control is stopped or cancelled if the system detects that the ripper 5 has been lifted or rotated, or that the blade 4 has been operated.

In step S18, it is determined whether or not the ripper 5 has been tilted in. That is, if the ripper operating lever 32 is in its tilt-in position, it is assumed that the operator is attempting to start the next ripping work, so the automatic ripper return control is released. This may be determined by detection of the position of the ripper operating lever 32. The automatic control can be effectively released by detecting operation in the opposite direction from that of the movement of the ripper 5 under the automatic control, and giving manual operation by the operator priority over automatic control.

In step S19, it is determined from the output of the timer 39 whether or not a specific length of time has elapsed since the output of a tilt-back command from the control device 40. This assumes a case in which the automatic ripper return control is not properly released after its start based on the release conditions of steps S16 to S18, and is a release condition set for the purpose of safety.

In this embodiment, as discussed above, when the automatic ripper return control is started, if any of the release conditions of steps S16 to S19 has been met, the automatic ripper return control is released and the system switches to normal control.

If manual operation is then detected in which the operator has switched operation of the ripper operating lever 32 (from tilt-back to tilt-in) or operation of the steering lever 33 (from reversing to advancing), priority is given to manual operation over automatic control and the ripper 5 is stopped, which provides greater safety in automatic control.

When the lift/tilt independent actuation selection button 64*c* is selected on the automatic control mode selection screen 64 shown in FIG. 6*c*, this automatic tilt control proceeds in parallel, independently from the above-mentioned automatic lift control.

Lift/Tilt Gang Automatic Control

Next, of the operations after completion of the above-mentioned ripping work, we will describe control in which the lifting and tilting of the ripper 5 in (4) and (5) shown in FIG. 4 are automated.

Specifically, when the lift/tilt linked actuation selection button 64*d* is selected on the automatic control mode selection screen 64, the above-mentioned automatic lift control and automatic tilt control are executed in conjunction.

More specifically, as shown in FIG. 9, from steps S1 to S9 the flow is the same as that in the automatic lift control shown in FIG. 7.

That is, when a mode is set for performing lift/tilt linked automatic control (third mode), it is determined whether or not the conditions of steps S2, S3, and S4 are satisfied in order starting from the normal control state in step S1, and if all the conditions have been met, in step S5 the control device 40 outputs a ripper lift command, and lifting operation is automatically carried out.

Next, when the release conditions in steps S6 to S9 are satisfied, the lifting operation is stopped, and in step S15 the control device 40 outputs a tilt-back command to start automatic tilt control. That is, in this mode, the automatic tilt control is started using the fact that automatic lift control has been released as a condition, without determining the various conditions for performing automatic tilt-back control (steps S12 to S14 in FIG. 8).

Just as with the automatic tilt control shown in FIG. 8 and discussed above, in steps S16 to S19, tilt-back is carried out automatically until the condition for releasing automatic tilt control is released, after which the system returns to normal control.

As discussed above, in this embodiment, the operator can selected from among three modes according to his preference.

Other Embodiments

An embodiment of the present invention was described above, but the present invention is not limited to or by the above embodiment, and various modifications are possible without departing from the gist of the invention.

(A)

In the above embodiment, examples were given for conditions for starting and releasing automatic ripper return control, but the present invention is not limited to or by these.

For example, other conditions may be added for starting or releasing the control, or some of the above-mentioned starting and releasing conditions may be omitted.

(B)

In the above embodiment, an example was given in which the above-mentioned automatic tilt control was performed only when lift/tilt independent actuation (second mode) and lift/tilt linked actuation (third mode) were selected, but the present invention is not limited to or by this.

For example, automatic tilt control can also be selected by itself on the setting screen.

Industrial Applicability

The bulldozer of the present invention has the effect of considerably reducing the operational burden on the operator during ripping work without having to depressing any particular control button or the like as compared to that in the past, and therefore can be widely applied to work vehicles equipped with a ripper.

The invention claimed is:

1. A control method for automatically controlling a ripper attached to a rear portion of a body of a bulldozer, the bulldozer having a ripper lifting device configured to raise and lower the ripper, a ripper tilting device configured to tilt the ripper in and out, an operating lever that is moveably provided and configured to actuate the ripper lifting device and the ripper tilting device, and a steering lever that is moveably provided and configured to control a drive unit of the bulldozer, said method comprising:

a first step in which it is determined whether ripping work by the ripper has ended;

a second step in which at least a first control of pulling the ripper out of a ground is automatically executed when it is determined that the ripping work has ended.

2. The control method for automatically controlling a ripper according to claim 1, further comprising a third step in which a user selects among a plurality of automatic control modes, the automatic control modes including at least a first mode in which only the first control is executed automatically in the second step.

3. The control method for automatically controlling a ripper according to claim 2, wherein it is determined that the ripping work has been ended when the steering lever has been moved to a reverse side during the ripping work and the operating lever has been moved to a lift position.

4. The control method for automatically controlling a ripper according to claim 3, wherein the automatic control modes include a second mode in which a second control of tilting back the ripper is executed automatically in the second step when it is determined both that the ripping work has ended and that the operating lever has been moved to a tilt-back position.

5. The control method for automatically controlling a ripper according to claim 3, further comprising a fourth step in which the first control is released when it is determined that the hydraulic pressure in a hydraulic circuit of the bulldozer has risen over a specific relief pressure, or that the bulldozer is moving forward or is stopped, or that the operating lever has been moved to a lowering position, or that at least a specific amount of time has elapsed since the operating lever was moved to the lift position.

6. The control method for automatically controlling a ripper according to claim 4, further comprising a fourth step in which the second control is released when it is determined that the hydraulic pressure in a hydraulic circuit of the bulldozer has risen over a specific relief pressure, or that the bulldozer is moving forward or is stopped, or that the operating lever has been moved to a tilt-in position, or that at least a specific amount of time has elapsed since the operating lever was moved to the tilt-back position.

7. The control method for automatically controlling a ripper according to claim 4, wherein the automatic control modes include a third mode in which the first and second controls are executed automatically when it is detected that the ripping work has ended.

8. The control method for automatically controlling a ripper according to claim 1, wherein it is determined that the ripping work has been ended when the steering lever has been moved to a reverse side during the ripping work and the operating lever has been moved to a lift position.

9. The control method for automatically controlling a ripper according to claim 4, further comprising;

a fourth step in which the first control is released when it is determined that the hydraulic pressure in a hydraulic circuit of the bulldozer has risen over a specific relief pressure, or that the bulldozer is moving forward or is stopped, or that the operating lever has been moved to a lowering position, or that at least a specific amount of time has elapsed since operating lever was moved to the lift position; and a fifth step in which the second control is released when it is determined that the hydraulic pressure in a hydraulic circuit of the bulldozer has risen over a specific relief pressure, or that the bulldozer is moving forward or is stopped, or that the operating lever has been moved to a tilt-in position, or that at least a specific amount of time has elapsed since the operating lever was moved to the tilt-back position.

* * * * *